US005862914A

United States Patent [19]

Farison et al.

[11] Patent Number: 5,862,914

[45] Date of Patent: Jan. 26, 1999

[54] INFLATABLE PACKAGE FOR PROTECTING AN ARTICLE

[75] Inventors: Brian Kent Farison, Gaylordsville, Conn.; Michel Pozzo, Neuilly, France

[73] Assignee: Sealed Air Corporation, Saddle Brook, N.J.

[21] Appl. No.: 756,001

[22] Filed: Nov. 25, 1996

[51] Int. Cl.[6] ..... B65D 81/02

[52] U.S. Cl. ..... 206/522; 206/814

[58] Field of Search ..... 206/522, 586, 206/591, 592, 594, 814; 383/3

[56] References Cited

U.S. PATENT DOCUMENTS

| | | |
|---|---|---|
| 1,457,496 | 6/1923 | Butler . |
| 3,889,743 | 6/1975 | Presnick . |
| 4,905,835 | 3/1990 | Pivert et al. . |
| 5,180,060 | 1/1993 | Forti et al. . |
| 5,348,157 | 9/1994 | Pozzo . |

FOREIGN PATENT DOCUMENTS

| | | |
|---|---|---|
| 1371316 | 7/1964 | France . |
| 2385606 | 10/1978 | France . |

*Primary Examiner*—Jacob K. Ackun

*Attorney, Agent, or Firm*—Bell Seltzer Intellectual Property Group of Alson & Bird LLP

[57] ABSTRACT

There is provided an inflatable packaging cushion for protecting an article and adapted to the shape and dimensions of an enclosed container. The inflatable packaging cushion has a plurality of inflatable chambers such that the sides and corners of the article are cushioned by the inflatable chambers. The inflatable chambers are interconnected through tie straps whereby at least one tie strap connects each chamber to an adjacent chamber. Each inflatable chamber includes a filling means for at least partially inflating each chamber with a filler medium. The inflatable chambers may assume various forms, depending on the shape of the article to be cushioned and the enclosed container. Additionally, there is provided a shipping container which includes a box and an inflatable packaging cushion for protecting an article adapted to the shape and dimensions of the box.

53 Claims, 5 Drawing Sheets

INFLATABLE PACKAGE FOR PROTECTING AN ARTICLE

BACKGROUND OF THE INVENTION

The present invention relates to inflatable packaging for protecting an article during shipment and storage. More particularly, the present invention relates to a packaging cushion having interconnected chambers which protect the sides and corners of an article during shipment and storage.

Protective packaging for articles of different sizes and shapes is commonly used to cushion articles during shipping and storage. There are numerous types and forms of packaging for this purpose including waste paper, embossed paper, air cellular packaging and plastic beads, known as peanuts. These forms of packaging do not always provide the cushioning needed when shipping or storing and are generally one-use items which are thrown away after use.

In seeking better protective packaging materials various forms of air inflatable cushions have been suggested. One such example of a package is disclosed in U.S. Pat. No. 5,348,157 to Pozzo which discloses several embodiments of an inflatable packaging cushion. In one embodiment, a cushion having a single chamber is designed to provide protection on four sides of a box. In another embodiment, the inflatable chamber extends around the entirety of the article.

In U.S. Pat. No. 5,180,060 to Forti, et al. there is described an inflatable packaging insert that is positioned around the sides of an article placed in a closed box. This inflatable packaging insert provides articulated panels having opposed edge portions for forming corners. In one embodiment, a pair of opposed V-shaped or triangular inserts forming a gusset allows the inflatable packaging insert, when inflated, to securely engage the corners of the article. A single valve is used to inflate each of the chambers encircling the article.

In yet another example of inflatable packaging material U.S. Pat. No. 4,905,835 to Pivert, et al. describes an inflatable package cushioning system which utilizes two separate inflatable cushions to protect all six sides of a box or article. Each of the cushions has articulated sides which fold to protect three sides of the article.

U.S. Pat. No. 3,889,743 to Presnick describes inflatable insulation for packaging including an inflatable cushion having a single inflation valve and articulated portions capable of protecting all six sides of a rectangular box. In addition, there is disclosed horizontal folding straps placed across at least one and advantageously two vertical lines of articulation of the liner.

Other examples of inflatable packaging include U.S. Pat. No. 1,457,496 to Butler; French Patent No. 2 385 606 to Asnieres; and French Patent 1.371.316 to Blanc et al. Thus, there is a need for inflatable packaging for use in shipping and storing of large products, however, the inflatable packaging must be manufactured economically so as to minimize material usage and waste.

SUMMARY OF THE INVENTION

Therefore, it is an object of the present invention to provide an inflatable packaging cushion for protecting all sides of an article during shipping and storage.

Another object of the present invention is to provide an inflatable packaging cushion for a wide range of article sizes, including large articles.

Another object of the present invention is to provide an inflatable packaging cushion which easily folds around the edges of a generally rectangular article.

Another object of the present invention is to provide an inflatable packaging cushion in which each chamber is separately inflated through a valve.

A further object of the present invention is to provide an inflatable packaging cushion in which at least two of the cushion chambers are attached together by at least one tie strap.

Yet another object of this invention is to provide an inflatable packaging cushion, the formation of which, economically minimizes material usage and waste.

It has been found that the foregoing objects are accomplished in accordance with this invention by providing an inflatable packaging cushion made of two sheets of air impervious material for protecting an article and adapted to the shape and dimensions of an enclosed container. The inflatable packaging cushion has an inflatable chamber positioned about each corner of the article to be cushioned. The inflatable chambers are made from two sheets of air impervious thermoplastic material juxtaposed on top of each other and having their outer peripheral edges sealed together. At least one tie strap interconnects each of the inflatable chambers to the adjacent chamber. The inflatable chambers are interconnected when formed from a flat blank until such time as the inflatable packaging cushion is oriented and inflated around the article. A filling means such as a self-sealing valve is provided in each chamber for at least partially inflating the chamber with a filler medium. The self-sealing inflation valve may be affixed to an internal face of one of the flexible sheets and opens to the outside of the chamber through an aperture provided in the sheet to which the valve is affixed.

In one embodiment of the present invention, the inflatable packaging cushion has separate chambers, each adapted to fold around a corner of the article to be protected, thus, selectively cushioning even large articles. Each inflatable chamber is separately inflated through a self-sealing valve. Each of the inflatable chambers is connected to the adjacent chamber by a tie strap the length of which serves to position each inflatable chamber relative to the others. Consequently, the selective cushioning of the article economically eliminates the use of excess thermoplastic material.

In another embodiment of the invention, the inflatable packaging cushion has separate inflatable chambers each of which substantially overlays one corner of the article such that the corner of the article is cushioned. Each of the chambers in this embodiment has an internal recess at each end of an internal opening. The internal recesses delimit a pair of wedging parts each capable of contacting a side of the article. The wedging parts are capable of pivoting during inflation to exert a holding pressure on the article. This embodiment is especially adapted for cushioning narrow or thin articles such as picture frames, but again can effectively cushion even large articles. The chambers are inflated through a self-sealing valve. Each of the inflated chambers is connected to the adjacent chamber by a tie strap which again positions each inflatable chamber relative to the others. The selective cushioning of the article economically minimizes the material necessary to construct the inflatable packaging cushion.

In a third embodiment of the invention, the inflatable packaging cushion has a pair of inflatable chambers that are positioned at each end of the article to be protected. Each chamber is somewhat larger than the end of the article being protected. The chamber of this embodiment has two internal openings adapted to receive the end of the article such that the sides of the article are encircled by the combined perimeters of the pair of internal openings. The chamber provides a central portion providing cushioning to the end of the article. This embodiment also allows the cushioning and storing of large articles. Each chamber is inflated through a self-sealing valve. The inflatable chambers are connected to each other by tie straps again to economically minimize material usage and to position each inflatable chamber relative to the other.

There has been provided an inflatable cushion adapted to protect large articles in which the cushion uses a minimum amount of plastic material. This is accomplished by selectively cushioning the necessary portions of the article to be cushioned and tying together with tie straps or stringers those selected areas.

BRIEF DESCRIPTION OF THE DRAWINGS

Other objects, features and advantages of the invention will become apparent from the following detailed description of the invention when taken in conjunction with the accompanying drawings, in which.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
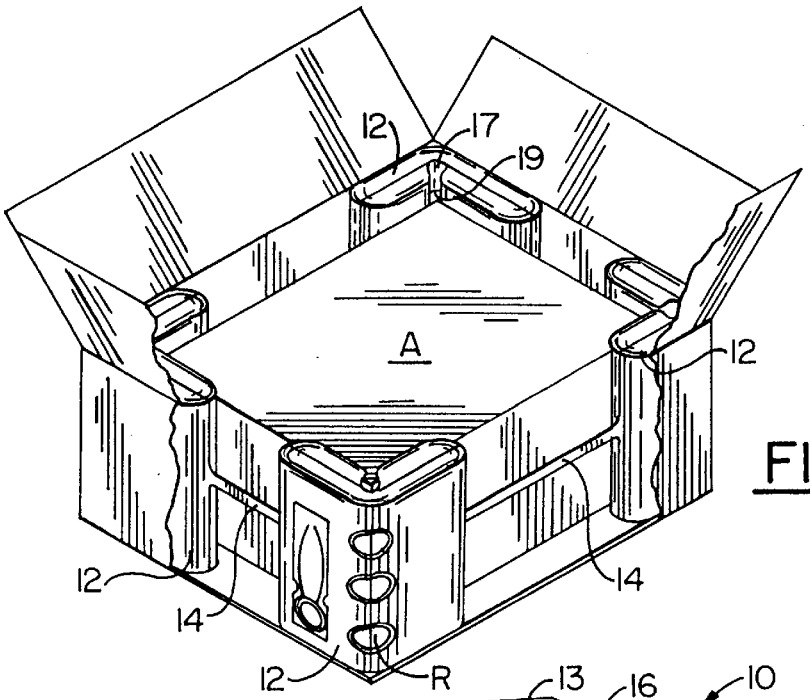
FIG. 1 is an isometric view illustrating an embodiment of the inflatable packaging cushion of the present invention in its inflated state surrounding an article to be protected as it is used in combination with a shipping container.
Figure 2A:
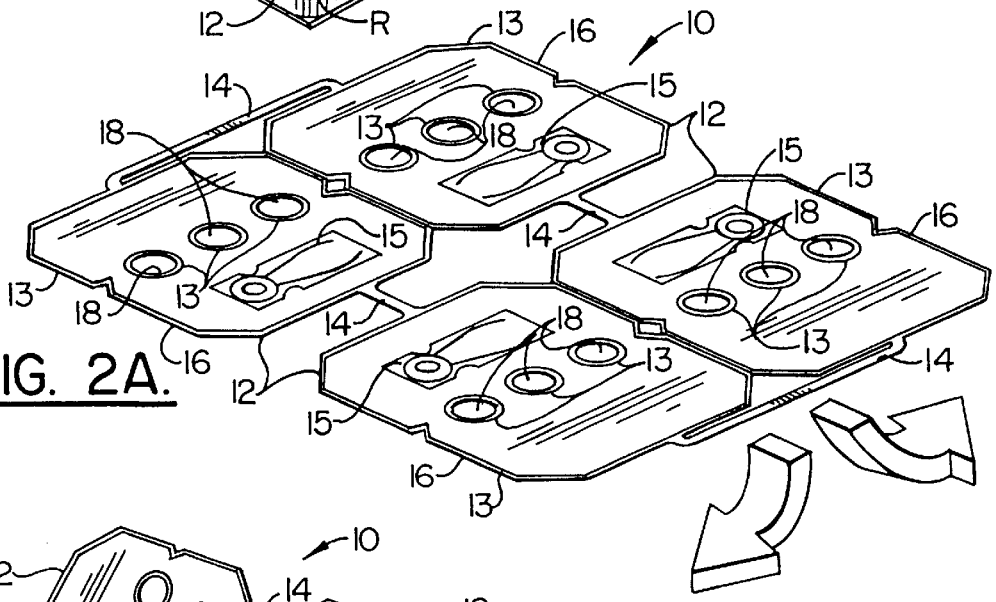
FIG. 2A is an isometric view of an embodiment of an inflatable packaging cushion made in accordance with this invention in its deflated state with directional arrows showing movement of the chambers as the chambers are placed around an article to be protected.
Figure 2B:
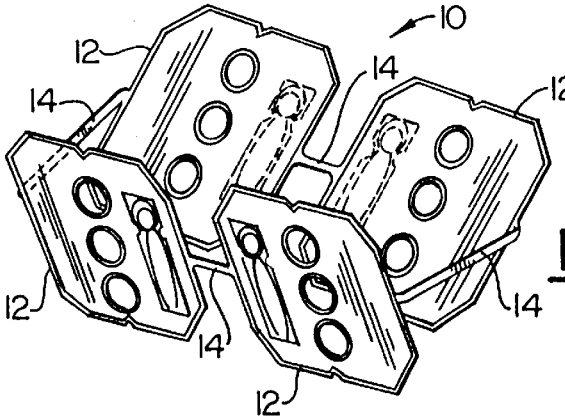
FIG. 2B is an isometric view of the inflatable packaging cushion of the present invention partially unfolded.
Figure 2C:
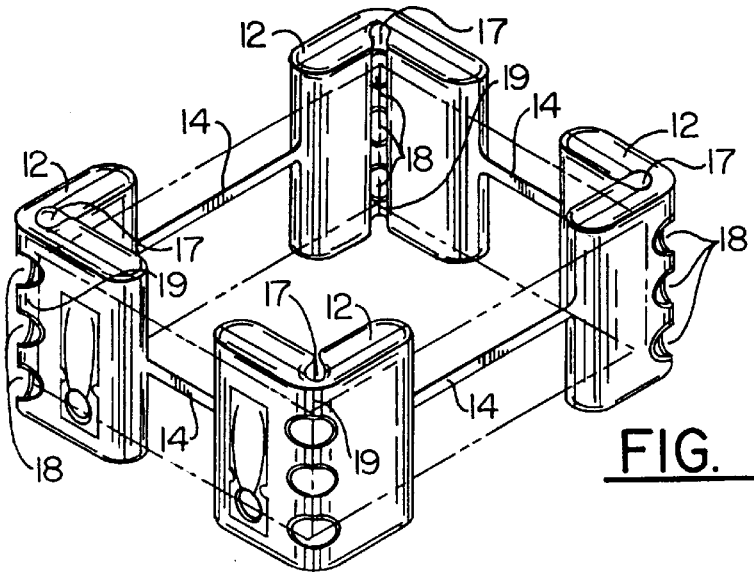
FIG. 2C is an isometric view of the inflatable packaging cushion of the present invention in its inflated state.
Figure 3:
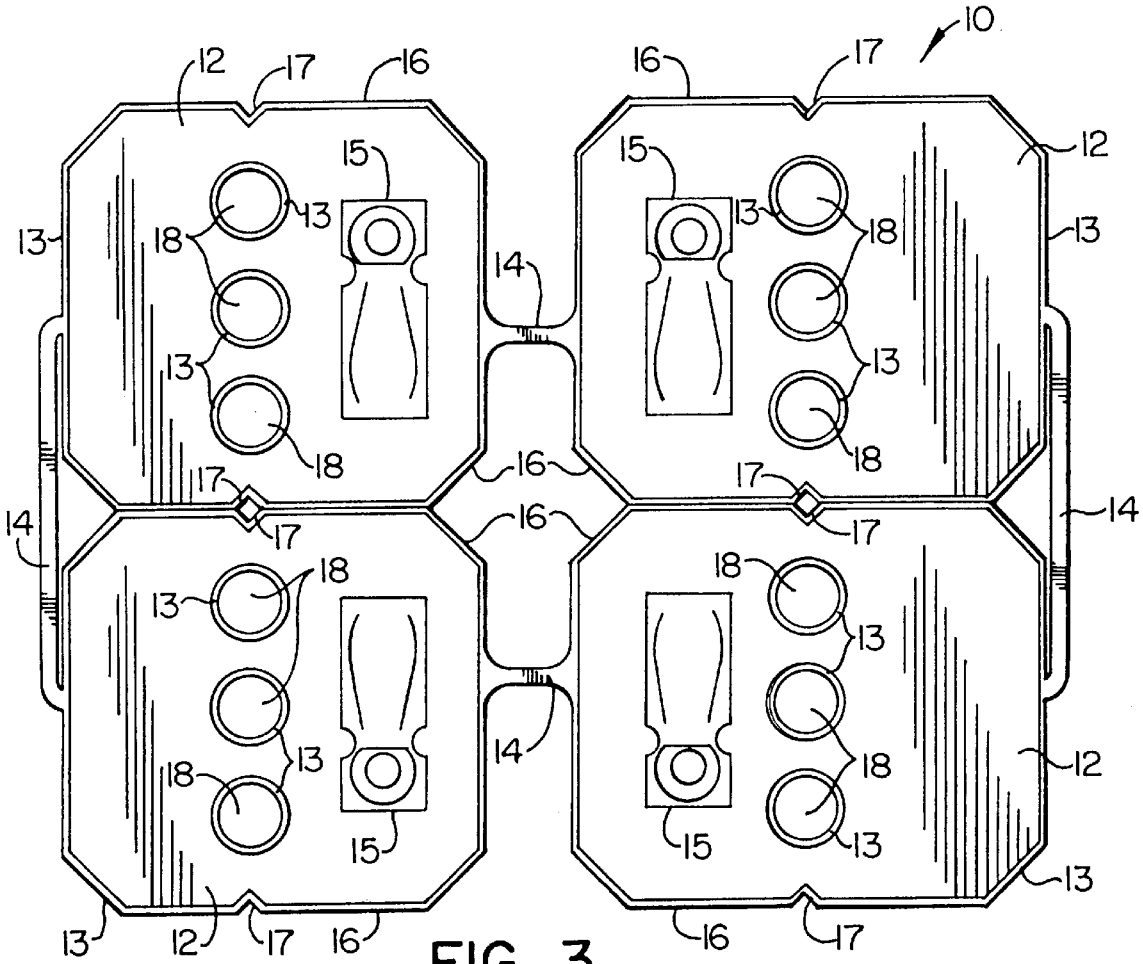
FIG. 3 is a plan view of the inflatable packaging cushion made in accordance with this invention in its deflated state.

Referring now to the drawings and in particular FIGS. 1–3, there is shown a first embodiment of an inflatable packaging cushion 10 made in accordance with the present invention surrounding an article A and adapted to be placed within a container C, for example, a box made from corrugated paperboard or the like. The inflatable packaging cushion 10 includes a plurality of chambers 12 interconnected through tie straps 14 and adapted to protect each of the corners R and adjacent sides of article A. This selective cushioning arrangement allows the inflatable packaging cushion 10 to be utilized to ship and store articles consisting of a broad range of sizes including large articles.

The inflatable packaging cushion 10 is made from two sheets of air impervious thermoplastic material which are sealed together around their external peripheral edge 16, forming weld lines 13. Any number of commercially available air impervious thermoplastic materials may be used, for example, polyethylene or polyurethane. The sheets are juxtaposed over each other and sealed together in the region of their peripheral edges—i.e., weld lines 13. The sealing may be performed by conventional techniques, for example, heat sealing. In addition, the internal edges are welded in the same manner also along weld lines 13 and the inflatable packaging cushion cut to form the various internal openings. The thermoplastic sheets should be sufficiently flexible to adapt to the contours of the article to be packaged and, at the same time, sufficiently robust not to be pierced by possible highly projecting or pointed parts of the article A to be protected. The inflatable packaging cushions of these materials can be deflated and reused but can also be incinerated, without release of toxic vapor, or can be recycled.

Figure 6:
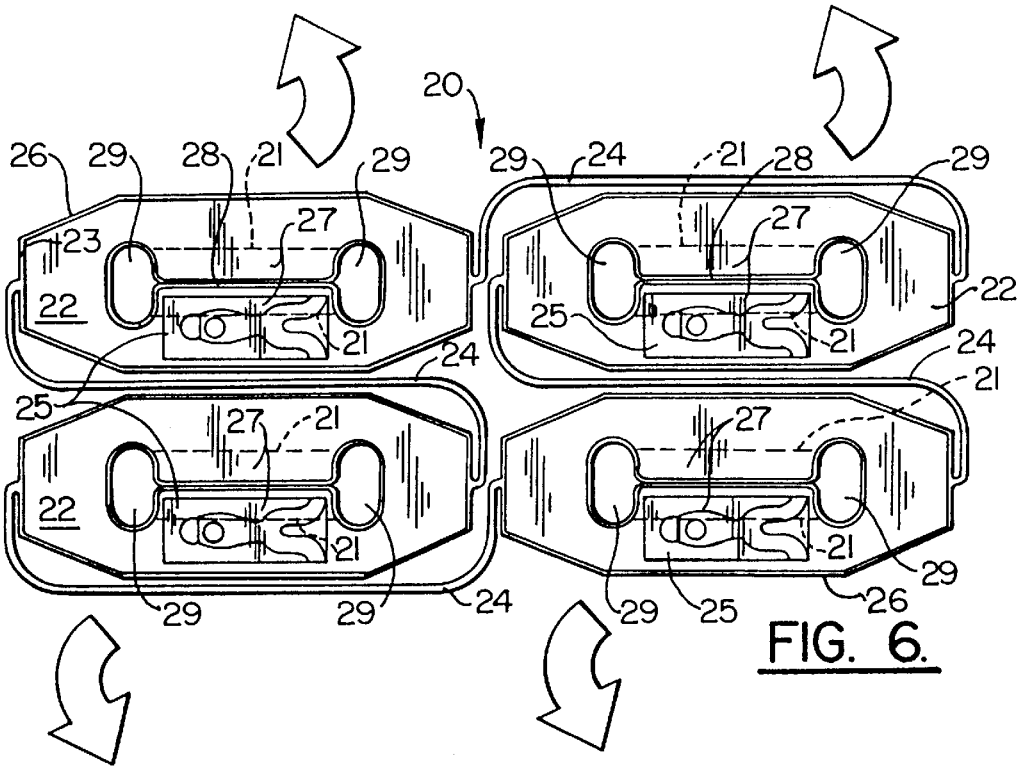
FIG. 6 is a plan view of the embodiment of FIG. 4 in its deflated state with directional arrows showing movement of the chambers as the chambers are placed around an article to be protected.
Figure 10:
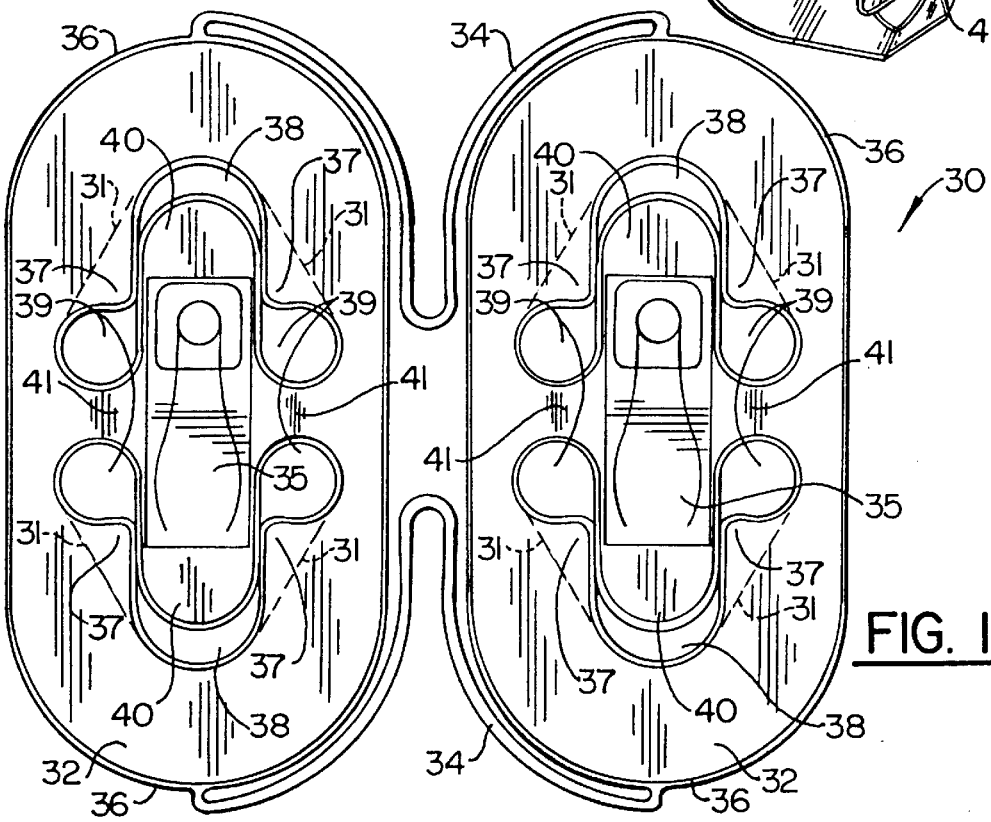
FIG. 10 is a plan view of the embodiment of FIG. 7 in its deflated state.

Referring to FIGS. 3, 6 and 10, the inflatable packaging cushion exits the manufacturing process in the deflated state as shown. The inflatable packaging cushion is manufactured in such a way as to economically minimize the usage of material by utilizing two thermoplastic sheets to form a flat blank of substantially the same area as the inflatable packaging cushion in its deflated state. Consequently, the thermoplastic material cut from the flat blank in order to form the inflatable chambers and interconnecting tie straps is thereby minimized.

Each chamber 12 includes a filling means 15 for partially filling each inflatable chamber 12. Filling means 15 is located internally of the peripheral edges 16 of chambers 12 and externally on a lateral face of chamber 12 opposite the surface engaging article A. Variations in shapes, sizes, and weights of article A may advantageously be incorporated into the inflatable packaging cushion 10 by alternatively increasing or decreasing the inflation in each chamber 12 and/or the lengths of tie straps 14.

The filling means 15 comprises a self-sealing inflation valve of a conventional type well known to those skilled in the art. Filling maybe accomplished by a filling gun, also well know by those skilled in the art. Each of the inflatable chambers 12 should be partially filled with the preferred filling medium being air. Partial filling advantageously enables the inflatable packaging cushion 10 to remain flexible and thus conform around the corners of article A which allows the inflatable packaging cushion 10 to absorb and dampen physical forces and shocks associated with the transportation of articles. Overfilling results in a rigid packaging cushion 10 that fails to conform satisfactorily to the size and shape of the article A as well as the possible rupturing of an inflatable chamber 12 due to a violent physical force or shock associated with transport.

Tie straps 14 may vary in length depending on the dimensions of the article A to be cushioned, thus varying the positioning of the inflatable chambers 12 relative to one another. The tie straps 14 are located on the lateral portion of the peripheral edges 16 of inflatable chambers 12, extending across and circumscribing the external surface of article A. The tie straps 14 provide support to maintain the inflatable chambers 12 in the desired position for cushioning. Thus, article A through tensional forces applied to the inflatable chambers 12 as a result of the pressure created by receiving an article A combined with the partial inflation of chambers 12 is protected. The tie straps 14 are made from thermoplastic sheets, preferably cut from the same source as the thermoplastic sheets used to form the inflatable chambers 12. The tie straps 14 may be cut integrally with the thermoplastic sheets forming the inflatable chambers 12 thereby interconnecting the inflatable chambers 12 when formed from the flat blank until such time as the inflatable packaging cushion is oriented and inflated around an article. Alternatively, the tie straps 14 are sealed between the thermoplastic sheets during the sealing of inflatable chambers 12.

As may better be seen in FIGS. 1 and 2C, each of the inflatable chambers 12 includes a plurality of openings 18, here three openings 18, located internally of the peripheral edges of each chamber 12, and notches 17 located axially of openings 18 on opposing peripheral edges. The openings 18 are sealed along weld line 13 at the internal edge of inflatable chamber 12. The openings serve to maintain the shape of the inflatable chamber 12 from being too bulky upon inflation and to allow the inflatable chamber 12 to bend around the corner R of article A. Notches 17, in pairs, delimit the distal ends of grooves 19 defined generally by openings 18. Thus, the thickness of the inflatable chambers 12 corresponding to grooves 19 is reduced compared to the thickness of inflatable chambers 12 generally. Notches 17, grooves 19, and openings 18 enable the inflatable chamber 12 when inflated to remain flexible so that the chamber 12 will securely engage the corner and adjacent sides of article A without any undesired deformation of the inflatable chamber 12. Preferably, openings 18 and grooves 19 should be located internally of the peripheral edges 16 of each chamber 12 and notches 17 disposed on the peripheral edges, axially aligned with openings 18 and grooves 19, such that when chamber 12 is inflated openings 18, notches 17, and groove 19 are positioned at the corner R of article A.

Figure 4:
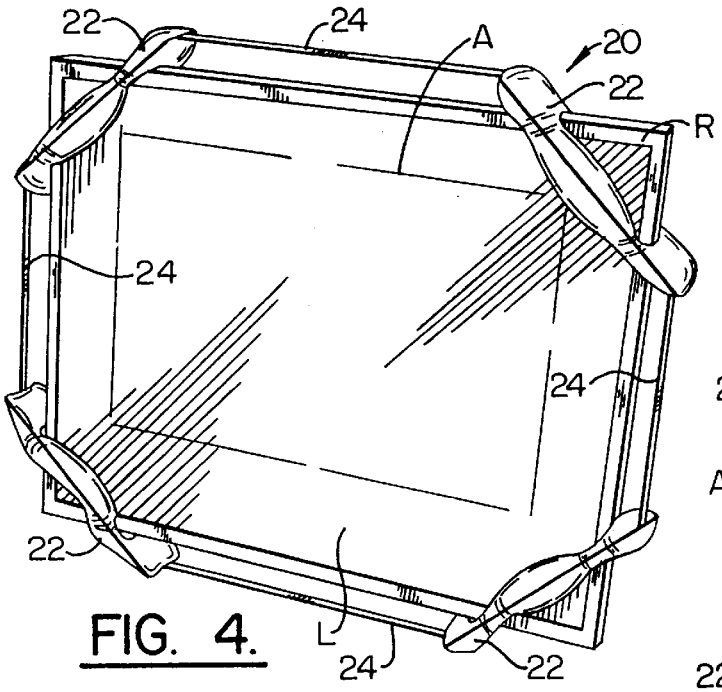
FIG. 4 is an isometric view of a second embodiment of the inflatable packaging cushion of the present invention in its inflated state surrounding an article to be protected.
Figure 5:
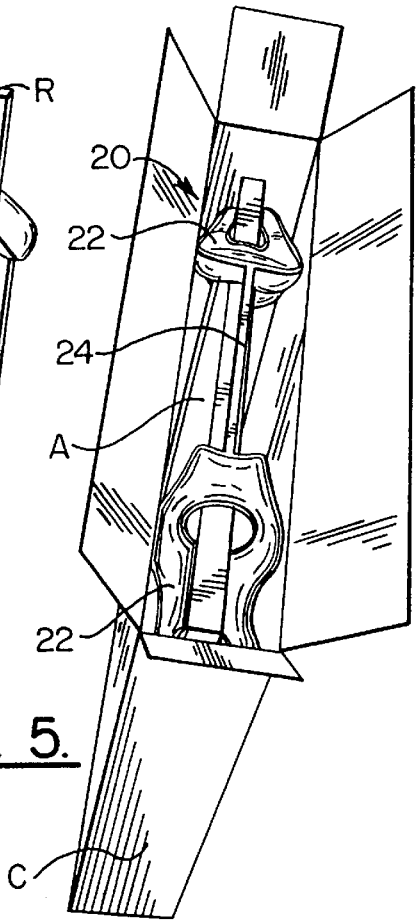
FIG. 5 is an isometric view of the embodiment of the inflatable packaging cushion of FIG. 4 in its inflated state surrounding an article to be protected as it is used in combination with a shipping container.

In another embodiment that is shown in FIGS. 4–6, there is provided an inflatable packaging cushion 20 including a plurality of inflatable chambers 22, here four inflatable chambers 22, having peripheral edges 26 describing essentially a rectangular main body portion with distal ends which are generally adapted to the shape and to the dimension of a container C, for example, a box made from corrugated paperboard or the like. The chambers 12 are made from thermoplastic sheets sealed around their peripheral edges 26 forming weld lines 23 in such a way as to economically minimize, through selective cushioning, the thermoplastic material used and any resulting waste. Tie straps 24 are located on the peripheral edge 26 of the distal ends of the inflatable chambers 22 thus interconnecting the chambers 22 to form the inflatable packaging cushion 20 and thereby circumscribe the external surface of article A. The length of tie straps 24 dictates the positioning of the inflatable chambers 22 relative to one another and provides support to maintain the inflatable chambers 22 in the desired position for effective cushioning. Thus, article A through tensional forces applied to said inflatable chambers 22 as a result of the pressure created by receiving an article A in internal openings 28 combined with the partial inflation of chambers 22 is protected.

Referring to FIGS. 4 and 5, the inflatable packaging cushion 20 is shown in the inflated state as applied to an article A to be cushioned. Each inflatable chamber 22 circumscribes an individual corner R of article A whereby inflatable chambers 22 interconnected through tie straps 24 form a single inflatable cushion 20 for cushioning all the external surfaces and lateral faces L of article A. Advantageously, inflatable packaging cushion 20 completely isolates all surfaces of article A from the internal surfaces of container C.

As best seen in FIG. 6, each inflatable chamber 22 includes an internal opening 28, capable of receiving a corner R of article A, internal openings 28 defined generally by internal recesses 29 extending from each of the corners of the internal opening 28 toward the peripheral edge 26 of the chamber 22. Internal opening 28 and internal recesses 29 delimit wedging parts 27 for engaging the lateral faces L of article A when the corner of article A is received through internal opening 28, wedging parts 27 being able to pivot during inflation of the inflatable chamber 22 around pivot lines 21 extending between internal recesses 29 from points nearest the peripheral edge 16. By pivoting, wedging parts 27 vary the size and the shape of each internal opening 28 whereby each internal opening 28 adapts to articles A of varying sizes and shapes while wedging parts 27 exert a continuous holding pressure on said article A.

A filling means, such as self-sealing valve 25, is located between internal recesses 29 on the external surface of each inflatable chamber 22 and delimited by wedging part 27. Preferably, after receiving an article A, each inflatable chamber 22 is partially filled to a level enabling the chamber 22 to cushion by dampening the physical forces and shocks associated with transport.

Figure 7:
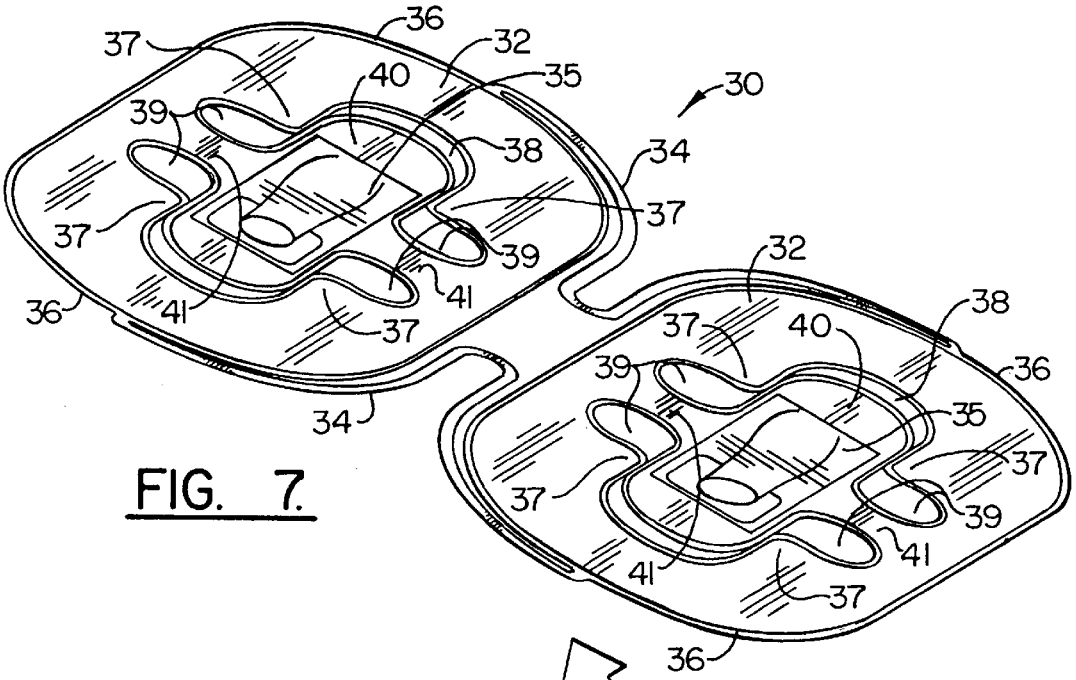
FIG. 7 is an isometric view illustrating a third embodiment of the inflatable packaging cushion of the present invention, in the deflated state.
Figure 8:
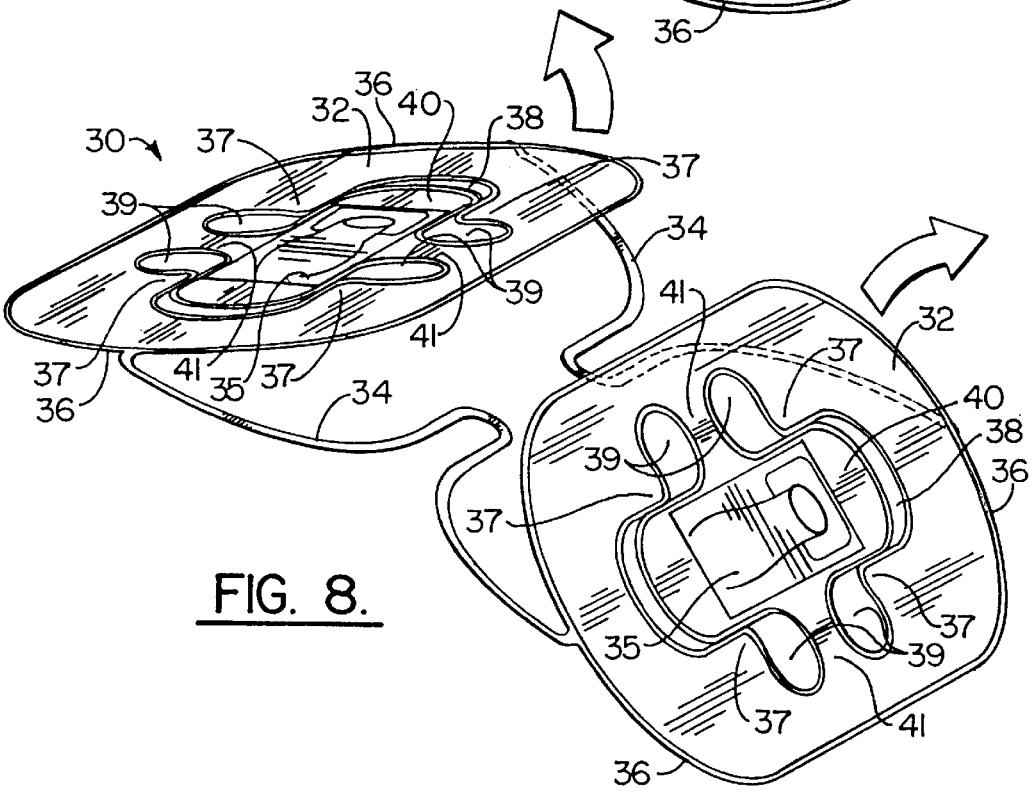
FIG. 8 is an isometric view of the embodiment of FIG. 7 in its deflated state and partially unfolded with directional arrows showing movement of the chambers as the chambers are placed around an article to be protected.

FIGS. 7 through 10 show another preferred embodiment made in accordance with the present invention. FIGS. 7 and 8 show an inflatable packaging cushion 30 including a plurality of inflatable chambers 32, here a pair of inflatable chambers, having peripheral edges 36 describing essentially an ellipsoid which is generally adapted to the shape and to the dimension of a container, for example, a box made from corrugated paperboard or the like. Inflatable chambers 32 include internal openings 38, capable of receiving an article to be cushioned, defined generally by internal recesses 39 which extend from the ends of internal openings 38 laterally toward the peripheral edges 36. The internal openings 38, being symmetrically disposed, in conjunction with the internal recesses 39 delimit an inflatable end chamber 40, also ellipsoid in configuration, for engaging and cushioning the distal ends of an article. Filling means 35 is centrally located on the external surface of inflatable end chamber 40 whereby the filling medium enters the inflatable end chamber 40 and proceeds to the remaining inflatable portions of inflatable chamber 32 through internal channels 41, located between opposing internal recesses 39. Inflatable end chamber 40 also retains filler medium thus providing cushioning to the end surface of the article.

Internal recesses 39 and internal openings 38 further define wedging parts 37 for engaging the lateral faces of an article when the article is inserted between internal openings 38. Wedging parts 37 are able to pivot during inflation of inflatable chambers 32 about pivot lines 31 disposed diagonally between internal opening 38 and internal recess 39 in order to vary the size and the shape of each internal opening 38 thus allowing each internal opening 38 to adapt to articles of varying sizes and shapes while the wedging parts 37 continuously exert a holding pressure on the article.

Figure 9:
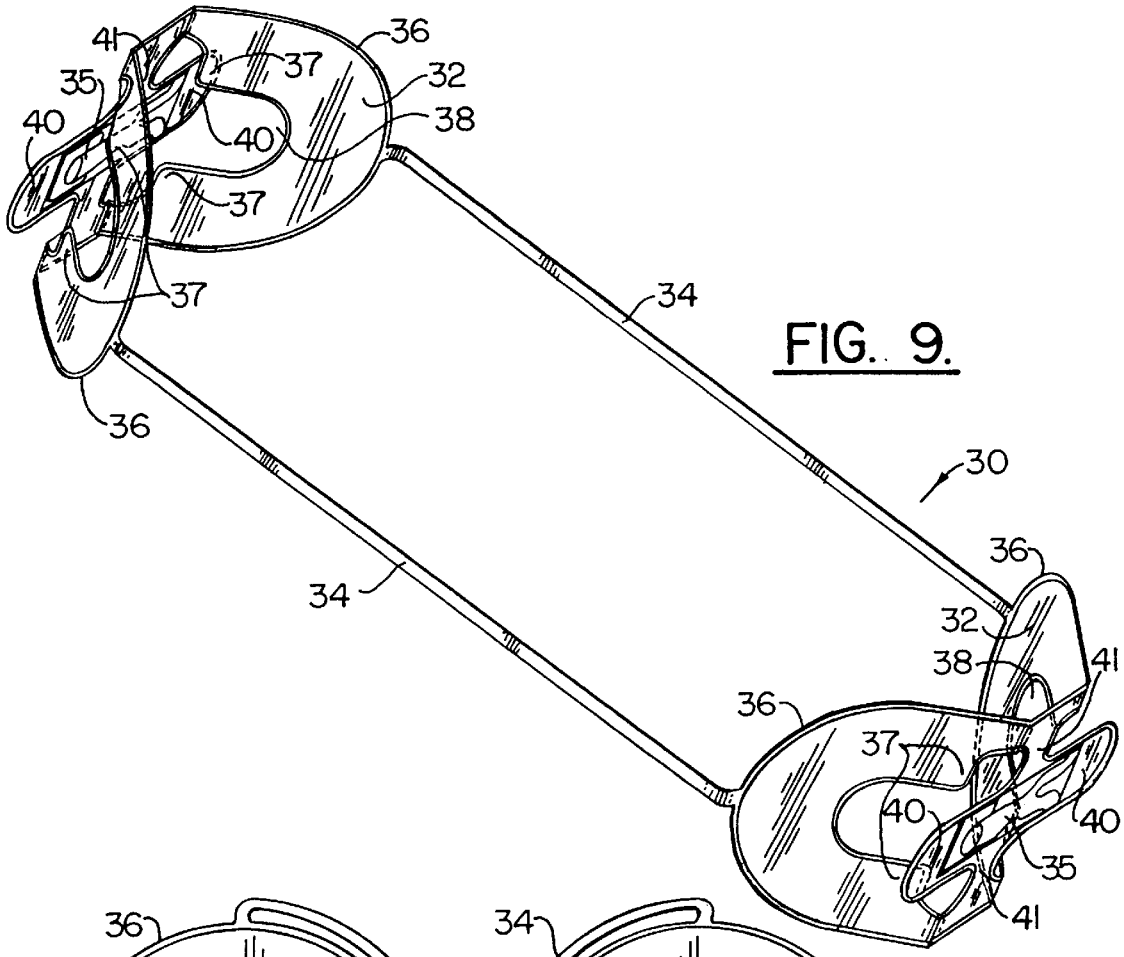
FIG. 9 is an isometric view of the embodiment of FIG. 7 in its deflated state, completely unfolded.

Referring specifically to FIGS. 9 and 10, tie straps 34 are located on the peripheral edge 36 of the distal ends of inflatable chambers 32 and interconnect the pair of inflatable chambers, thus forming a single inflatable packaging cushion 30 and thereby circumscribing the external surface of the article. As the end of an article is received in internal openings 38 for cushioning, inflatable chambers 32 deform slightly to engage the lateral surfaces of the article allowing wedging parts 37 to initiate a holding pressure on said lateral surfaces. The end surface of the article engages the fully extended and partially inflated end chamber 40. The tie straps 34 provide support to inflatable chambers 32 thus sustaining the deformation around the lateral surfaces of the article through tensional forces applied to said inflatable chambers 32 as a result of the pressure created by receiving the article combined with the partial inflation of chambers 32. The tension in tie straps 34 results in a secure engagement between the inflatable packaging cushion 30 and the article thus providing support and cushioning to the lateral surfaces and end face of the article.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. An inflatable packaging cushion for protecting the corners of a generally rectangular article and adapted to the shape and dimensions of an enclosed container comprising:

a plurality of inflatable chambers such that each corner of said article is cushioned by an inflatable chamber;

at least one tie strap interconnecting each of said chambers to the adjacent chamber; and a filling means for each of said chambers for at least partially inflating each inflatable chamber with a filler medium.

2. The inflatable packaging cushion according to claim 1 wherein each of said inflatable chambers comprises a pair of juxtaposed thermoplastic sheets having the outer peripheral edges thereof sealed together to form said inflatable chamber.

3. The inflatable packaging cushion according to claim 1 wherein said filling means is a self-sealing inflation valve.

4. The inflatable packaging cushion according to claim 1 wherein each of said inflatable chambers substantially overlays one corner of said article.

5. The inflatable packaging cushion according to claim 1 wherein each of said inflatable chambers includes at least one opening located internally of said peripheral edges whereby each of said inflatable chambers when inflated may provide cushioning to one of said corners and adjacent sides of said article and said opening being located at said corner of said article when said chamber is inflated.

6. The inflatable packaging cushion according to claim 1 wherein each of said inflatable chambers includes at least one opening located internally of said peripheral edges whereby said opening may provide flexibility for securely engaging one of said corners and said adjacent sides of said article and said opening being located at said corner of said article when said chamber is inflated.

7. The inflatable packaging cushion according to claim 1 wherein each of said inflatable chambers includes at least one internal opening capable of receiving a corner of said article such that said corner and adjacent sides are completely encircled by the perimeter of said internal opening whereby each of said chambers when inflated may provide cushioning to one of said corners and adjacent sides of said article.

8. The inflatable packaging cushion according to claim 1 wherein each of said inflatable chambers includes an internal recess positioned at each of the distal ends of each of said internal openings, said internal recesses delimiting in pairs at least a pair of wedging parts being capable of contacting said adjacent sides of said article, said wedging parts being able to pivot during inflation of the inflatable chamber in order to vary the size and the shape of said internal opening whereby each of said internal openings adapts to articles of varying sizes and shapes, said pair of wedging parts exerting a holding pressure on said article.

9. The inflatable packaging cushion according to claim 1, said inflatable packaging cushion having a pair of inflatable chambers such that one end and each of the lateral surfaces of said article are protected and cushioned by one of said inflatable chambers; and at least two tie straps interconnecting each end of said inflatable chambers to the other chamber.

10. The inflatable packaging cushion according to claim 1, said inflatable packaging cushion having a pair of inflatable chambers wherein each of said inflatable chambers includes at least two internal openings, the combination of said pair of internal openings being capable of receiving an end of an article such that the lateral surfaces of said article are encircled by the combined perimeters of said pair of internal openings, said pair of internal openings delimiting an inflatable end chamber, said end chamber capable of engaging said end face of said article, whereby said pair of inflatable chambers when inflated may provide cushioning to each end and adjacent lateral surfaces of said article.

11. The inflatable packaging cushion according to claim 1 wherein a pair of inflatable chambers includes an internal recess at each end of a pair of internal openings, each said internal recess delimiting a wedging part capable of contacting a lateral surface of an article, said wedging parts being able to pivot during inflation of the inflatable chamber in order to vary the size and the shape of said internal opening whereby each of said internal openings adapts to articles of varying sizes and shapes, said wedging parts exerting a holding pressure on said article.

12. An inflatable packaging cushion for protecting an article having corners, said inflatable packaging cushion adapted to the shape and dimensions of an enclosed container and comprising:

a plurality of inflatable chambers, wherein each of said inflatable chambers substantially overlays one corner of said article such that each said corner of said article is cushioned;

at least one tie strap interconnecting each of said inflatable chambers to the adjacent chamber; and a filling means for each of said inflatable chambers for at least partially inflating each chamber with a filler medium.

13. The inflatable packaging cushion according to claim 12 wherein each of said inflatable chambers comprises a pair of juxtaposed thermoplastic sheets having the outer peripheral edges thereof sealed together to form said inflatable chamber.

14. The inflatable packaging cushion according to claim 12 wherein said filling means is a self-sealing inflation valve.

15. The inflatable packaging cushion according to claim 12 wherein each of said inflatable chambers includes at least one opening located internally of said peripheral edges whereby each of said inflatable chambers when inflated may provide cushioning to one of said corners and adjacent sides of said article and said opening being located at said corner of said article when said chamber is inflated.

16. The inflatable packaging cushion according to claim 12 wherein each of said inflatable chambers includes at least one opening located internally of said peripheral edges whereby said opening may provide flexibility for securely engaging one said corner and said adjacent sides of said article and said opening being located at said corner of said article when said chamber is inflated.

17. An inflatable packaging cushion for protecting an article having corners, said inflatable packaging cushion adapted to the shape and dimensions of an enclosed container and comprising:

a plurality of inflatable chambers, each of said inflatable chambers comprises a pair of juxtaposed thermoplastic sheets having the outer peripheral edges thereof sealed together to form said inflatable chamber and wherein each of said inflatable chambers substantially overlays one corner of said article such that each said corner of said article is cushioned, each of said inflatable chambers includes at least one opening located internally of said peripheral edges whereby said opening may provide flexibility to said inflatable chamber for securely engaging one said corner and said adjacent sides of said article and such that said inflatable chambers when inflated may provide cushioning to one of said corners and adjacent sides of said article, said opening being located at said corner of said article when inflated;

at least one tie strap interconnecting each of said inflatable chambers to the adjacent chamber; and a filling means for each of said inflatable chambers for at least partially inflating each chamber with a filler medium, wherein said filling means is a self-sealing inflation valve.

18. An inflatable packaging cushion for protecting an article having corners and adapted to the shape and dimensions of an enclosed container comprising:

a plurality of inflatable chambers, each of said inflatable chambers includes at least one internal opening capable of receiving a corner of an article such that said corner and adjacent sides are completely encircled by the perimeter of said internal opening whereby each of said inflatable chambers when inflated may provide cushioning to one of said corners and adjacent sides of said article;

at least one tie strap interconnecting each of said inflatable chambers to the adjacent chamber; and a filling means for each of said inflatable chambers for at least partially inflating each chamber with a filler medium.

19. The inflatable packaging cushion according to claim 18 wherein each of said inflatable chambers comprises a pair of juxtaposed thermoplastic sheets having the outer peripheral edges thereof sealed together to form said inflatable chamber.

20. The inflatable packaging cushion according to claim 18 wherein said filling means is a self-sealing inflation valve.

21. The inflatable packaging cushion according to claim 18 wherein each of said inflatable chambers includes an internal recess positioned at each of the distal ends of each of said internal openings, said internal recesses delimiting in pairs at least a pair of wedging parts being capable of contacting said adjacent sides of said article, said wedging parts being able to pivot during inflation of the inflatable chamber in order to vary the size and the shape of said internal opening whereby each of said internal openings adapts to articles of varying sizes and shapes, said pair of wedging parts exerting a holding pressure on said article.

22. An inflatable packaging cushion for protecting an article having corners, said inflatable packaging cushion adapted to the shape and dimensions of an enclosed container and comprising:

a plurality of inflatable chambers, wherein each of said inflatable chambers comprises a pair of juxtaposed thermoplastic sheets having the outer peripheral edges thereof sealed together to form said inflatable chamber, each of said inflatable chambers includes at least one internal opening capable of receiving a corner of an article such that said corner and adjacent sides are completely encircled by the perimeter of said internal opening, wherein each of said inflatable chambers includes an internal recess positioned at each of the distal ends of each of said internal openings, said internal recesses delimiting in pairs at least a pair of wedging parts being capable of contacting said adjacent sides of said article, said wedging parts being able to pivot during inflation of the inflatable chamber in order to vary the size and the shape of said internal opening whereby each of said internal openings adapts to articles of varying sizes and shapes, said pair of wedging parts exerting a holding pressure on said article whereby each of said inflatable chambers when inflated may provide secure cushioning to one of said corners and adjacent sides of said article;

at least one tie strap interconnecting each of said inflatable chambers to the adjacent chamber; and a filling means for each of said inflatable chambers for at least partially inflating each chamber with a filler medium, wherein said filling means is a self-sealing inflation valve.

23. An inflatable packaging cushion for protecting an article and adapted to the shape and dimensions of an enclosed container comprising:

a pair of inflatable chambers such that one end and each of the lateral surfaces of said article are protected and cushioned by one of said inflatable chambers;

at least two tie straps interconnecting each of said inflatable chambers to the other chamber; and a filling means for each of said inflatable chambers for at least partially inflating each chamber with a filler medium.

24. The inflatable packaging cushion according to claim 23 wherein each of said inflatable chambers comprises a pair of juxtaposed thermoplastic sheets having the outer peripheral edges thereof sealed together to form said inflatable chamber.

25. The inflatable packaging cushion according to claim 23 wherein said filling means is a self-sealing inflation valve.

26. The inflatable packaging cushion according to claim 23, said inflatable packaging cushion having a pair of inflatable chambers wherein each of said inflatable chambers includes at least two internal openings, the combination of said pair of internal openings being capable of receiving an end of an article such that the lateral surfaces of said article are encircled by the combined perimeters of said pair of internal openings, said pair of internal openings delimiting an inflatable end chamber, said inflatable end chamber capable of engaging said end face of said article, whereby said pair of inflatable chambers when inflated may provide cushioning to each end and lateral surfaces of said article.

27. The inflatable packaging cushion according to claim 23 wherein a pair of inflatable chambers includes internal recesses positioned at each end of a pair of internal openings, each said internal recess delimiting a wedging part capable of contacting a lateral surface of said article, said wedging part being able to pivot during inflation of the inflatable chamber in order to vary the size and the shape of said internal opening whereby each of said internal openings adapts to articles of varying sizes and shapes, said wedging parts exerting a holding pressure on said article.

28. An inflatable packaging cushion for protecting an article and adapted to the shape and dimensions of an enclosed container comprising:

said inflatable packaging cushion having a pair of inflatable chambers such that one end and each of the lateral surfaces of said article are protected and cushioned by one of said inflatable chambers, each of said inflatable chambers comprises a pair of juxtaposed thermoplastic sheets having the outer peripheral edges thereof sealed together to form said inflatable chamber, each of said inflatable chambers includes at least two internal openings, the combination of said pair of internal openings being capable of receiving an end of an article such that the lateral surfaces of said article are encircled by the combined perimeters of said pair of internal openings, said pair of internal openings delimiting an inflatable end chamber, said inflatable end chamber being capable of engaging said end face of said article, each of said inflatable chambers includes internal recesses positioned at each end of a pair of internal openings, each said internal recess delimiting a wedging part capable of contacting a lateral surface of said article, said wedging part being able to pivot during inflation of the inflatable chamber in order to vary the size and the shape of said internal opening whereby each of said internal openings adapts to articles of varying sizes and shapes, said wedging parts exerting a holding pressure on said article, whereby said pair of inflatable chambers when inflated may provide secure cushioning to each end and adjacent lateral surfaces of said article;

at least two tie straps interconnecting each of said inflatable chambers to the other chamber; and a filling means for each of said inflatable chambers for at least partially inflating each chamber with a filler medium, wherein said filling means is a self-sealing inflation valve.

29. A shipping container for an article comprising a box; and an inflatable packaging cushion for protecting an article and adapted to the shape and dimensions of said box comprising:

said inflatable packaging cushion having a plurality of inflatable chambers such that each corner of said article is cushioned by an inflatable chamber;

at least one tie strap interconnecting each of said inflatable chambers to the adjacent chamber; and a filling means for each of said inflatable chamber for at least partially inflating each chamber with a filler medium.

30. The shipping container according to claim 29 wherein said inflatable chambers comprises a pair of juxtaposed thermoplastic sheets having the outer peripheral edges thereof sealed together to form said inflatable chamber.

31. The shipping container according to claim 29 wherein said filling means is a self-sealing inflation valve.

32. The shipping container according to claim 29 wherein each of said inflatable chambers substantially overlays one said corner of said article such that each of said corners of said article is cushioned.

33. The shipping container according to claim 29 wherein each of said inflatable chambers includes at least one opening located internally of said peripheral edges whereby each of said inflatable chambers when inflated may provide cushioning to one of said corners and adjacent sides of said article and said opening being located at said corner of said article when said chamber is inflated.

34. The shipping container according to claim 29 wherein each of said inflatable chambers includes at least one opening located internally of said peripheral edges whereby said opening may provide flexibility for securely engaging one said corner and said adjacent sides of said article and said opening being located at said corner of said article when said chamber is inflated.

35. The shipping container according to claim 29 wherein each of said inflatable chambers includes at least one internal opening capable of receiving a corner of said article such that said corner and adjacent sides are completely encircled by the perimeter of said internal opening whereby each of said inflatable chambers when inflated may provide cushioning to one of said corners and adjacent sides of said article.

36. The shipping container according to claim 29 wherein each of said inflatable chambers includes an internal recess positioned at each of the distal ends of each of said internal openings, said internal recesses delimiting in pairs at least a pair of wedging parts being capable of contacting said adjacent sides of said article, said wedging parts being able to pivot during inflation of the inflatable chamber in order to vary the size and the shape of said internal opening whereby each of said internal openings adapts to articles of varying sizes and shapes, said pair of wedging parts exerting a holding pressure on said article.

37. The shipping container according to claim 29, said shipping container having a pair of inflatable chambers such that one end and each of the lateral surfaces of said article are protected and cushioned by one of said inflatable chambers;

at least two tie straps interconnecting each of said inflatable chambers to the other chamber.

38. The shipping container according to claim 29, said shipping container having a pair of inflatable chambers wherein each of said inflatable chambers includes at least two internal openings, the combination of said pair of internal openings being capable of receiving an end of an article such that the lateral surfaces of said article are encircled by the combined perimeters of said pair of internal openings, said pair of internal openings delimiting an inflatable end chamber, said inflatable end chamber capable of engaging said end face of said article, whereby said pair of inflatable chambers when inflated may provide cushioning to each end and adjacent lateral surfaces of said article.

39. The shipping container according to claim 29 wherein a pair of inflatable chambers includes an internal recess positioned at each end of a pair of internal openings, each said internal recess delimiting a wedging part capable of coming into contact with a lateral surface of an article, said wedging part being able to pivot during inflation of the inflatable chamber in order to vary the size and the shape of said internal opening whereby each of said internal openings adapts to articles of varying sizes and shapes, said wedging parts exerting a holding pressure on said article.

40. A shipping container for an article, said shipping container comprising:

a box; and an inflatable packaging cushion for protecting an article and adapted to the shape and dimensions of said box comprising:

said inflatable packaging cushion having a plurality of inflatable chambers, each of said inflatable chambers substantially overlaying one said corners of said article such that each of said corners of said article is cushioned;

at least one tie strap interconnecting each of said inflatable chambers to the adjacent chamber; and a filling means for each of said inflatable chamber for at least partially inflating each chamber with a filler medium.

41. The shipping container according to claim 40 wherein said inflatable chambers comprises a pair of juxtaposed thermoplastic sheets having the outer peripheral edges thereof sealed together to form said inflatable chamber.

42. The shipping container according to claim 40 wherein said filling means is a self-sealing inflation valve.

43. The shipping container according to claim 40 wherein each of said inflatable chambers includes at least one opening located internally of said peripheral edges whereby each of said chambers when inflated may provide cushioning to one of said corners and adjacent sides of said article and said opening being located at said corner of said article when said chamber is inflated.

44. The shipping container according to claim 40 wherein each of said inflatable chambers includes at least one opening located internally of said peripheral edges whereby said opening may provide flexibility for securely engaging one said corner and said adjacent sides of said article and said opening being located at said corner of said article when said chamber is inflated.

45. A shipping container for an article, said shipping container comprising:

an inflatable packaging cushion for protecting an article adapted to the shape and dimensions of an enclosed container comprising:

said packaging cushion having a plurality of inflatable chambers, each of said inflatable chambers includes at least one internal opening capable of receiving a corner of an article such that said corner and adjacent sides are completely encircled by the perimeter of said internal opening whereby each of said chambers when inflated may provide cushioning to one of said corners and adjacent sides of said article;

at least one tie strap interconnecting each of said inflatable chambers to the adjacent chamber; and a filling means for each of said inflatable chamber for at least partially inflating each chamber with a filler medium.

46. The shipping container according to claim 45 wherein said inflatable chambers comprises a pair of juxtaposed thermoplastic sheets having the outer peripheral edges thereof sealed together to form said inflatable chamber.

47. The shipping container according to claim 45 wherein said filling means is a self-sealing inflation valve.

48. The shipping container according to claim 45 wherein each of said inflatable chambers includes an internal recess positioned at each of the distal ends of each of said internal openings, said internal recesses delimiting in pairs at least a pair of wedging parts being capable of coming into contact with said adjacent sides of said article, said wedging parts being able to pivot during inflation of the inflatable chamber in order to vary the size and the shape of said internal opening whereby each of said internal opening adapts to articles of varying sizes and shapes, said pair of wedging parts exerting a holding pressure on said article.

49. A shipping container for an article, said shipping container comprising:

an inflatable packaging cushion for protecting an article adapted to the shape and dimensions of an enclosed container comprising:

said inflatable packaging cushion having a pair of inflatable chambers such that one end and each of the lateral surfaces of said article are protected and cushioned by one of said inflatable chambers;

at least two tie straps interconnecting each of said inflatable chambers to the other chamber; and a filling means for each of said inflatable chambers for at least partially inflating each chamber with a filler medium.

50. The shipping container according to claim 49 wherein each of said inflatable chambers comprises a pair of juxtaposed thermoplastic sheets having the outer peripheral edges thereof sealed together to form said inflatable chamber.

51. The shipping container according to claim 49 wherein said filling means is a self-sealing inflation valve.

52. The shipping container according to claim 49, said shipping container having a pair of inflatable chambers wherein each of said inflatable chambers includes at least two internal openings, the combination of said pair of internal openings being capable of receiving an end of an article such that the lateral surfaces of said article are encircled by the combined perimeters of said pair of internal openings, said pair of internal openings delimiting an inflatable end chamber, said inflatable end chamber being capable of engaging said end face of said article, whereby said pair of inflatable chambers when inflated may provide cushioning to each end and adjacent lateral surfaces of said article.

53. The shipping container according to claim 49 wherein a pair of inflatable chambers includes an internal recess positioned at each end of a pair of internal openings, each said internal recess delimiting a wedging part capable of coming into contact with a lateral surface of an article, said wedging part being able to pivot during inflation of the inflatable chamber in order to vary the size and the shape of said internal openings whereby each of said internal openings adapts to articles of varying sizes and shapes, said pair of wedging parts exerting a holding pressure on said article.

* * * * *

UNITED STATES PATENT AND TRADEMARK OFFICE

CERTIFICATE OF CORRECTION

PATENT NO. : 5,862,914

DATED : January 26, 1999

INVENTOR(S) : Farison et al.

It is certified that error appears in the above-identified patent and that said Letters Patent is hereby corrected as shown below:

On the title page, Item [56],

In the References Cited, U.S. PATENT DOCUMENTS, add two patents:

--4,874,093 10/1989 Pharo 5,454,642 10/1995 DeLuca--.

In the Firm name, "Alson" should read --Alston--.

Signed and Sealed this

Twenty-ninth Day of June, 1999

*Attest:*

Q. TODD DICKINSON

*Attesting Officer*

*Acting Commissioner of Patents and Trademarks*